US005735221A

United States Patent [19]

Benayon

[11] Patent Number: 5,735,221

[45] Date of Patent: Apr. 7, 1998

[54] BACKROOM SHELVING SYSTEM

[76] Inventor: Jaime Benayon, 400 Fenmar Drive., Weston, Ontario, Canada, M9L 1M6

[21] Appl. No.: 651,039

[22] Filed: May 17, 1996

[30] Foreign Application Priority Data

Apr. 12, 1996 [CA] Canada ..... 2174008

[51] Int. Cl.[6] ..... A47B 9/00

[52] U.S. Cl. ..... 108/107; 211/187; 211/135; 108/187; 108/186

[58] Field of Search ..... 211/187, 135, 211/186; 108/107, 110, 180, 156, 153, 186, 187

[56] References Cited

U.S. PATENT DOCUMENTS

| | | | |
|---|---|---|---|
| 3,199,471 | 8/1965 | Orsi | 108/187 |
| 3,438,344 | 4/1969 | Ferdinand et al. | 108/110 |
| 4,148,263 | 4/1979 | Suttles | 108/186 X |
| 4,549,665 | 10/1985 | Smitley | 108/187 X |
| 4,564,111 | 1/1986 | Suttles | 108/187 X |
| 4,607,576 | 8/1986 | Kranjec | 108/186 X |
| 4,795,042 | 1/1989 | Klein et al. | 211/135 X |
| 4,821,649 | 4/1989 | Andersson | 211/187 X |
| 5,036,778 | 8/1991 | Briosi | 211/187 X |

FOREIGN PATENT DOCUMENTS

| | | | |
|---|---|---|---|
| 425861 | 5/1991 | European Pat. Off. | 211/186 |
| 838359 | 6/1960 | United Kingdom | 211/135 |
| 2122880 | 1/1984 | United Kingdom | 108/153 |

*Primary Examiner*—Peter M. Cuomo
*Assistant Examiner*—Janet M. Wilkens
*Attorney, Agent, or Firm*—Shoemaker and Mattare, Ltd.

[57] ABSTRACT

A shelving construction which includes upright members having a U-shaped cross-section and a plurality of shelves connected between the upright members, is improved by providing at least one stiffener plate extending between and into two upright members disposed so that the flanks of each upright member extend toward the other upright member. The stiffener plate has an effective width so as to be snugly received within the upright members. Each upright member defines at least one bridging portion, and the stiffener plate has, for each bridging portion, two spaced-apart protrusions such that the bridging portion can snap into place between the protrusions when the stiffener plate is inserted into the respective upright member.

12 Claims, 5 Drawing Sheets

BACKROOM SHELVING SYSTEM

This invention relates generally to the construction of shelving of the kind typically used in warehouses and storage applications.

BACKGROUND OF THIS INVENTION

Many retail and wholesale outlets make extensive use of storage shelving for the warehousing of products. A typical such construction normally involves fasteners such as metal screws or bolts with regular or wing nuts, along with appropriate tools for tightening the fasteners. Designs of this kind tend to require substantial time for assembly and disassembly.

GENERAL DESCRIPTION OF THE INVENTION

In view of the above shortcomings of the current shelving designs, the aim of one aspect of this invention is to provide a shelving construction requiring no tools and no fasteners, thus permitting quick assembly and disassembly, the design being flexible enough to permit a wide range of widths and lengths for the individual shelf components.

More particularly, this invention provides a shelving construction comprising a) a plurality of upright members each having substantially a U-shaped cross-section including two opposed, flat, uniformly spaced-apart, substantially parallel flanks interconnected by a web portion from which the flanks extend, each flank terminating at a respective free edge; b) a plurality of shelves connected between upright members; and c) at least one stiffener plate sized to extend between and into two upright members which are disposed such that the flanks of each upright member extend toward the other upright member, the stiffener plate having an effective width such that it is snugly received within both upright members, each upright member defining at least one bridging portion, the stiffener plate having, for each bridging portion, two spaced-apart protrusions such that said bridging portion can snap into the space between the protrusions when the stiffener plate is inserted into the respective upright members; the stiffener plate being a substantially rectangular panel having two opposed edges adapted to enter respective upright members, and a further two opposed edges along catch of which a marginal portion is bent substantially at right angles, the width of the marginal portions determining said snug reception into the upright members; each of the upright members connected by a given stiffener plate having a pair of longitudinally spaced-apart apertures in at least one flank, each aperture being spaced inward from the corresponding free edge of the flank, whereby each said bridging portion is defined by an integral, vertical, longitudinally extending strap of material between the aperture and the free edge; and in which the stiffener plate has two horizontally spaced-apart protrusions for snugly receiving each said bridging portion.

Further, this invention provides a shelving construction comprising a) a plurality of upright members each having substantially a U-shaped cross-section including two opposed, spaced-apart substantially parallel flanks interconnected by a web portion from which the flanks extend; b) a plurality of shelves connected between upright members; and c) at least one stiffener plate sized to extend between and into two upright members which are disposed such that the flanks of each upright member extend toward the other upright member, the stiffener plate having an effective width such that it is snugly received within both upright members, each upright member defining at least one bridging portion, the stiffener plate having, for each bridging portion, two spaced-apart protrusions such that said bridging portion can snap into be space between the protrusions when the stiffener plate is inserted into the respective upright member; at least one flank of each upright member having a plurality of longitudinally spaced-apart, stamped-out tongues, each tongue being integral with the flank along a joining line parallel with the upright member, a major portion of each tongue lying parallel with the respective flank but spaced outward therefrom; each said shelf including a main panel with substantially straight edges of which two are rectilinear end edges intended for securement to upright members; each said end edge having an attachment margin projecting downwardly at right angles from said main panel, said attachment margin having at each end a recess defined at least in part by an upright edge, whereby the shelf can be supported from the upright members with the two upright edges being lodged between the respective tongues and the respective flanks of the upright members, with the weight of the shelf being carried by the tongues, the main panel of each shelf being rectangular with the end edges being the shorter edges, each of the longer two edges having an integral, downwardly extending side wall of uniform vertical extent, which in turn has a horizontal flange extending inwardly from the bottom of the side wall, the inner corner at each end of the flange being notched to avoid mechanical interference with the supporting tongues during installation and removal of the shelf.

In addition, this invention provides in a shelving construction including a) a plurality of upright members each having substantially a U-shaped cross-section including two opposed, spaced-apart flanks interconnected by a web portion from which the flanks extend; and b) a plurality of shelves connected between upright members; the improvement comprising:

the provision, on at least one flank of each upright member, of a plurality of longitudinally spaced-apart, stamped-out tongues, each tongue being integral with the flank along a joining line parallel with the upright member, a major portion of each tongue lying parallel with the respective flank but spaced outward therefrom; each said shelf including a main panel with substantially straight edges of which two are rectilinear end edges intended for securement to upright members; each said end edge having an attachment margin projecting downwardly at right angles from said main panel, said attachment margin having at each end a recess defined at least in part by an upright edge, whereby the shelf can be supported from the upright members with the two upright edges lodged between the respective tongues and the respective flanks of the upright members, with the weight of the shelf being carried by the tongues, the main panel of each shelf being rectangular with the end edges being the shorter edges, each of the longer two edges having an integral, downwardly extending side wall of uniform vertical extent, which in turn has a horizontal flange extending inwardly from the bottom of the side wall, the inner corner at each end of each flange being notched to avoid mechanical interference with the supporting tongues during installation and removal of the shelf.

Finally, the invention provides a shelving construction comprising: a) a plurality of upright members each having substantially a U-shaped cross-section including two opposed, spaced-apart flanks interconnected by a web portion from which the flanks extend; b) a plurality of shelves connected between upright members; and, c) on at least one flank of each upright member, a plurality of longitudinally spaced-apart, stamped-out tongues, each tongue being integral with the flank along a joining line parallel with the upright member, a major portion of each tongue lying parallel with the respective flank but spaced outward therefrom; each said shelf including a main panel with substantially straight edges of which two are rectilinear end edges intended for securement to upright members; each said end edge having an attachment margin projecting downwardly at right angles from said main panel, said attachment margin having at each end a recess defined at least in part by an upright edge, whereby the shelf can be supported from the upright members with the two upright edges lodged between the respective tongues and the respective flanks of the upright members, with the weight of the shelf being carried by the tongues, the main panel of each shelf being rectangular with the end edges being the shorter edges, each of the longer two edges having an integral, downwardly extending side wall of uniform vertical extent, which in turn has a horizontal flange extending inwardly from the bottom of the side wall, the inner corner at each end of each flange being notched to avoid mechanical interference with the supporting tongues during installation and removal of the shelf.

BRIEF DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
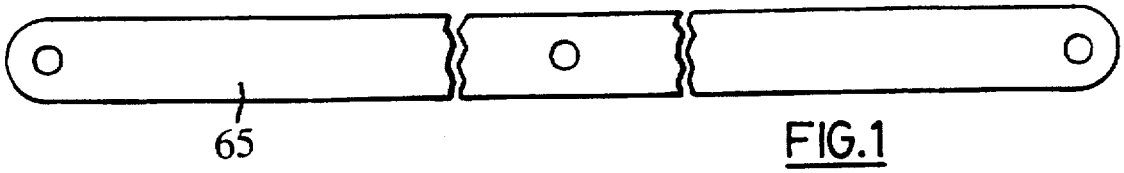
FIG. 1 is a collapsed plan view of a cross-brace for a shelving unit.
Figure 2:
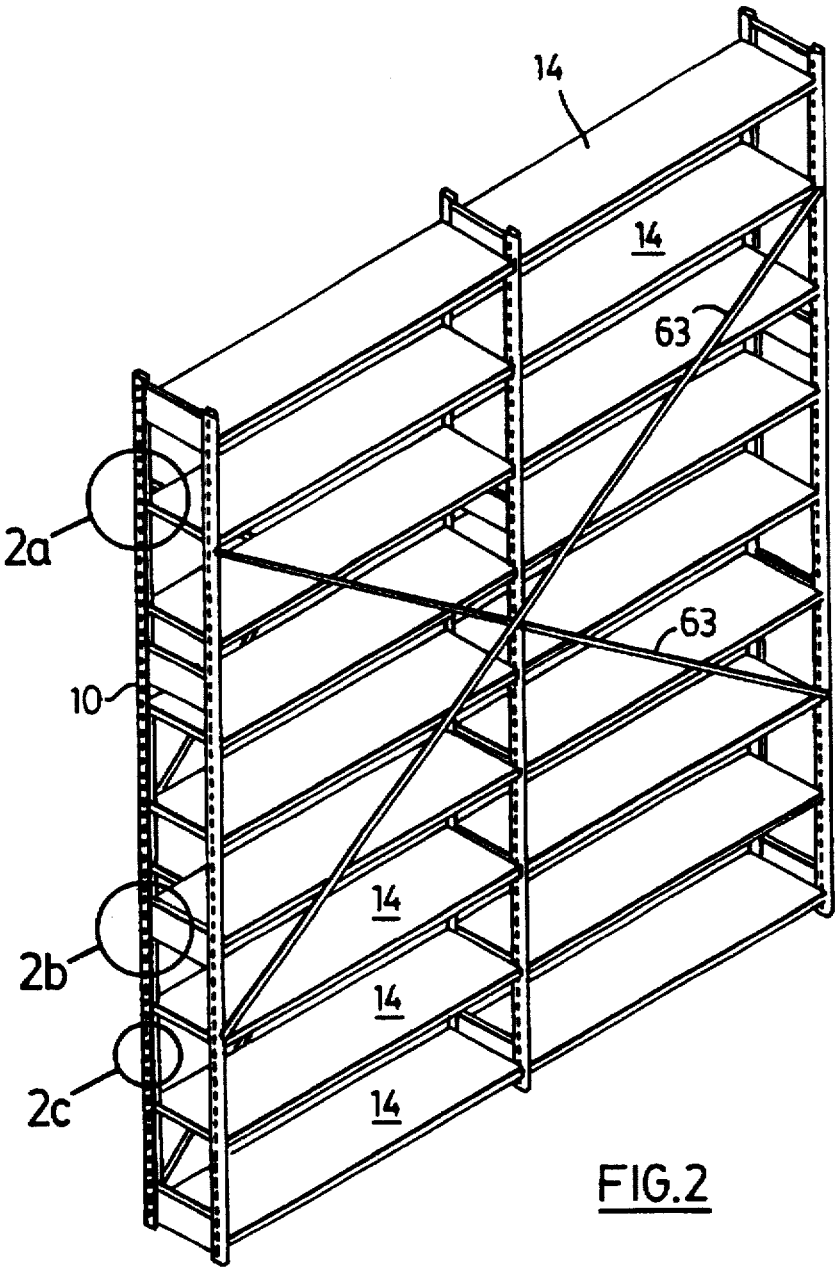
FIG. 2 is a perspective view of a complete shelving unit with selected portions being shown, to a larger scale, within circular outlines to the left.
Figure 2A:
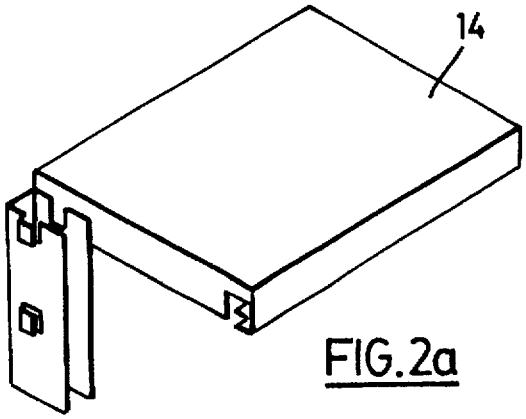
FIGS. 2*a*, 2*b* and 2*c* are perspective views showing details of portions of FIG. 2 at the circled locations identified as 2*a*, 2*b* and 2*c*, respectively.
Figure 2B:
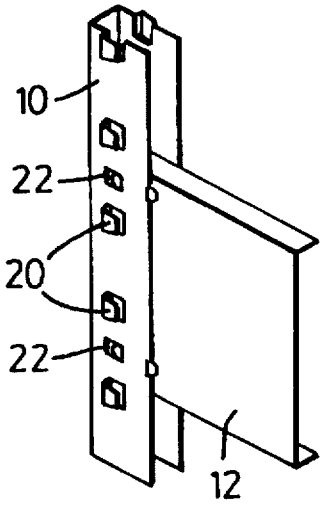
Figure 2C:
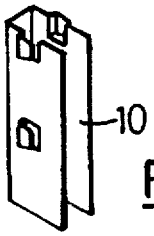

As shown in FIG. 2, the shelving system of this invention includes three main components. The first component is the upright 10 which is U-shaped in cross-section, and which has certain openings and tongues punched along its two flanks, for interaction with the other main components. The second of the main components is a stiffener plate 12, which is essentially a rectangular plate with marginal portions folded through 90° along the longer two sides of the rectangle. The main purpose of the stiffener plate 12 is to rigidify the shelving structure in the back-and-forth sense. The third component is a shelf 14.

Figure 5:
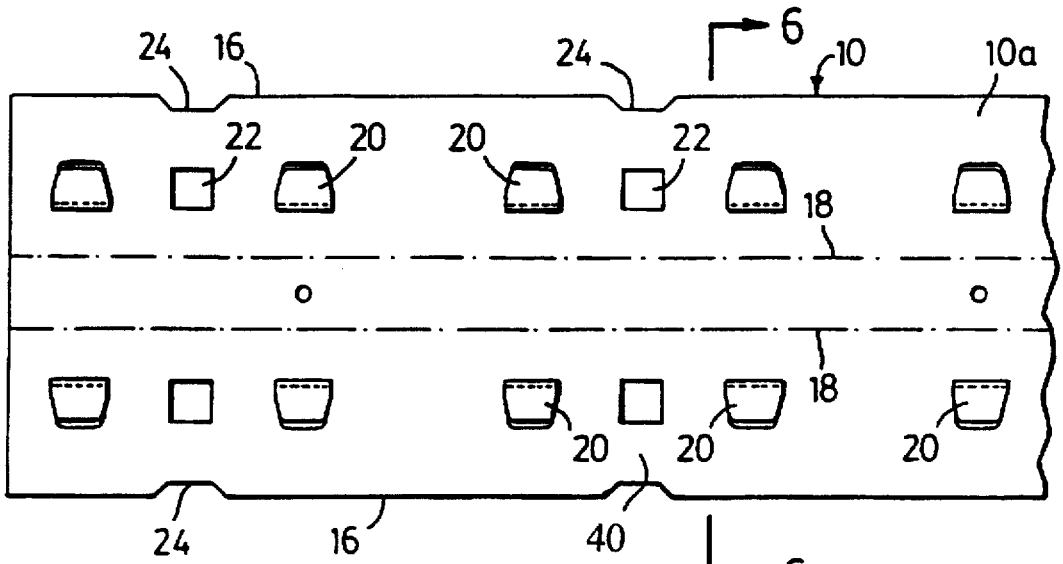
FIG. 5 is a partial plan view of a blank intended to form an upright, after the stamping process but prior to folding.
Figure 6:
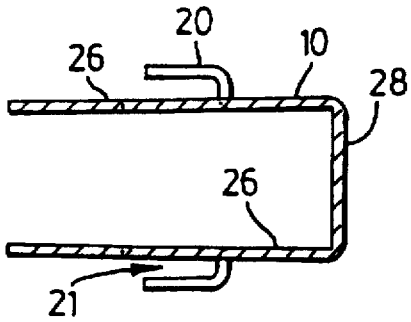
FIG. 6 is a sectional view through an upright (after being folded) taken at the line 6—6 in FIG. 5.

Dealing firstly with the upright 10, attention is directed to FIGS. 5 and 6. FIG. 5 shows the configuration of the metal stamping after it has received punched openings and tongues, but before it is folded to the U-configuration required for interaction with the other components. In FIG. 5, the upright blank 10*a* has parallel longitudinal side edges 16, internal fold lines 18 parallel to the edges 16, and a plurality of equally spaced-apart, punched-out tongues 20. In the embodiment illustrated, the tongues 20 are spaced equally apart in the longitudinal direction of the upright 10. It will be noted the tongues 20 are approximately trapezoidal in shape and that the terminal portion (the part that is parallel with the remainder of the blank) is spaced away from the material from which it is stamped out, leaving a gap 21, the purpose of which will become clear from what follows. The gap 21 is clearly seen in FIG. 6.

Also provided in the upright blank 10*a* are a plurality of apertures 22, which are square in the embodiment illustrated. It will be noted that the apertures 22 are spaced centrally between alternate pairs of the tongues 20, with the result that there are twice as many tongues 20 as there are apertures 22.

It will also be noted in FIG. 5 that the longitudinal edges 16 of the upright blank 10*a* exhibit trapezoidal indents 24 in transverse alignment with each of the square apertures 22, each indent 24 and its corresponding aperture defining between them an upright bridge of material 40. The indents 24 are also clearly seen in FIG. 3.

In FIG. 6, it can be seen that the final form of the upright 10, after being formed into a U-shape, is one in which two flanks 26 converge slightly toward each other from opposite edges of a web 28.

The punched-out tongues 20 support the shelf components 14, while the apertures 22 and indents 24 interact with the stiffener plates 12.

As can be seen by looking at FIGS. 2, 3, 7 and 8, each stiffener plate 12 is essentially a rectangular piece of metal, with marginal portions 30 folded at right angles to improve stiffness. It will be seen particularly in FIG. 3 that each marginal portion 30 of the stiffener plate 12 has bevels 34 at both ends. The purpose of the bevels is to facilitate initial entry of an end of the stiffener plate 12 into the space between the flanks 26 of the respective upright. By appropriate sizing, the fit of the stiffener plate 12 into the upright 10 can be made as snug as required.

Figure 3:
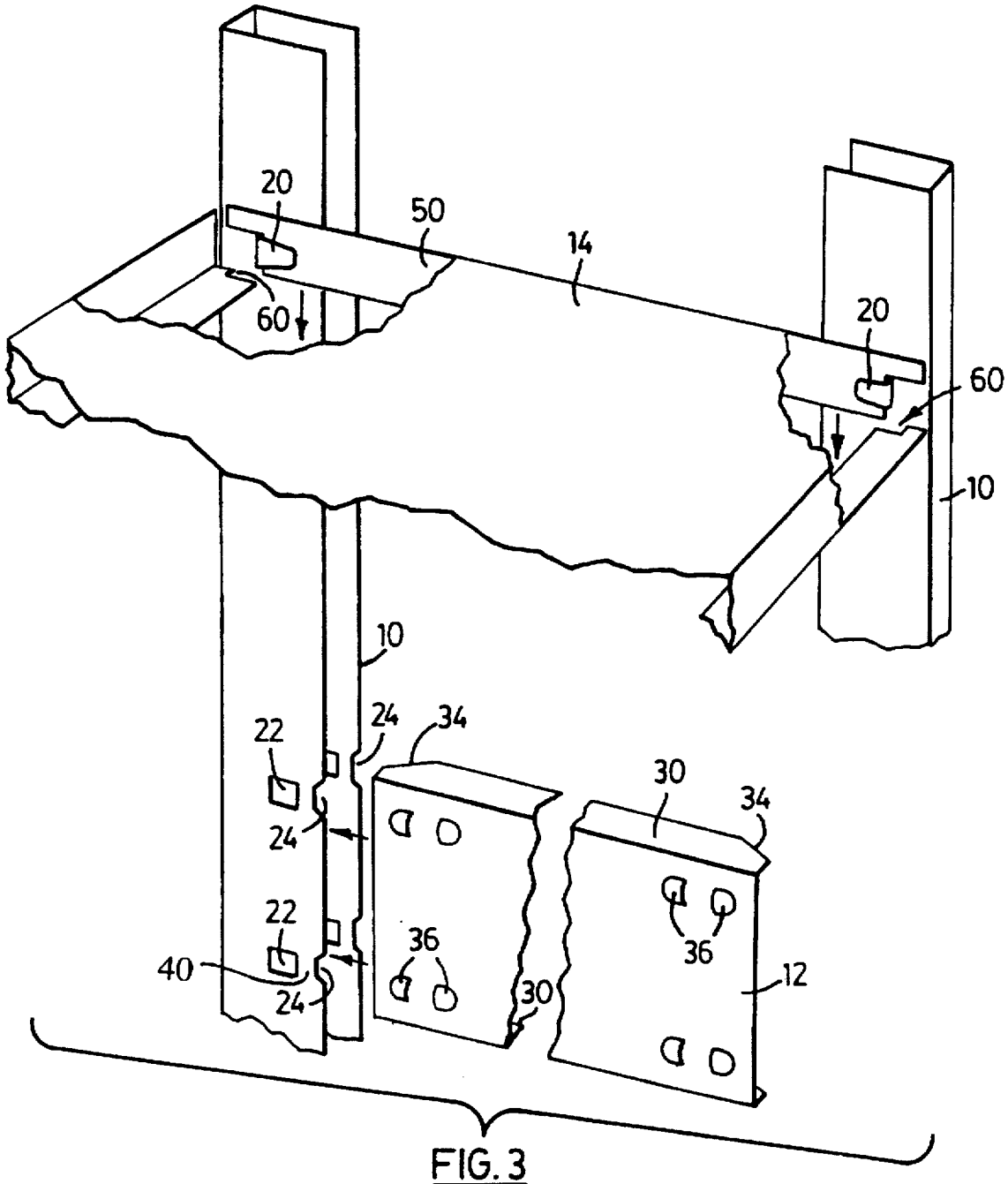
FIG. 3 is a partial, broken-away view of a stiffener plate, two uprights and a shelf, illustrating the interconnections between these components.
Figure 7:
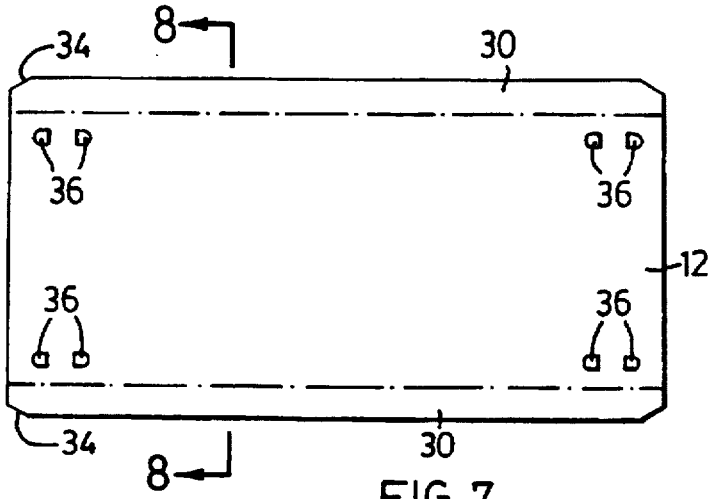
FIG. 7 is a plan view of a blank for the stiffener plate component of the shelving of this invention, after stamping but prior to folding.
Figure 8:
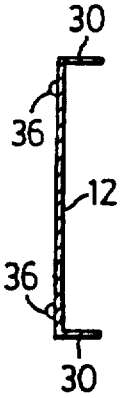
FIG. 8 is an end view of the stiffener plate of FIG. 7, after folding.

As best seen in FIGS. 3 and 7, the stiffener plate 12 has four pairs of offset protrusions 36, each pair being horizontally aligned and separated by the same amount. By providing the separation between each pair of protrusions 36, it is possible to lodge the stiffener plate 12 within the upright 10 in such a way that each upright bridge of material 40 lodges between one of the pairs of protrusions 36. In FIG. 3, this would involve the leftward two pairs of protuberances 36.

It will be understood that a similar connection occurs at the other end of the stiffener plate 12, which interacts with another upright (partly shown in FIG. 3, but broken away to avoid cluttering).

It should be noted that, in FIG. 3, the uprights 10 are not illustrated with all of the tongues, apertures and indents that are provided in the final product. Such details have been omitted in order to avoid cluttering the drawing.

Figure 10:
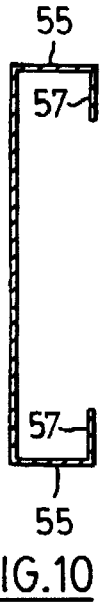
FIG. 10 is a sectional view through the blank of FIG. 9, after folding, taken at the line 10—10 in FIG. 9.
Figure 9:
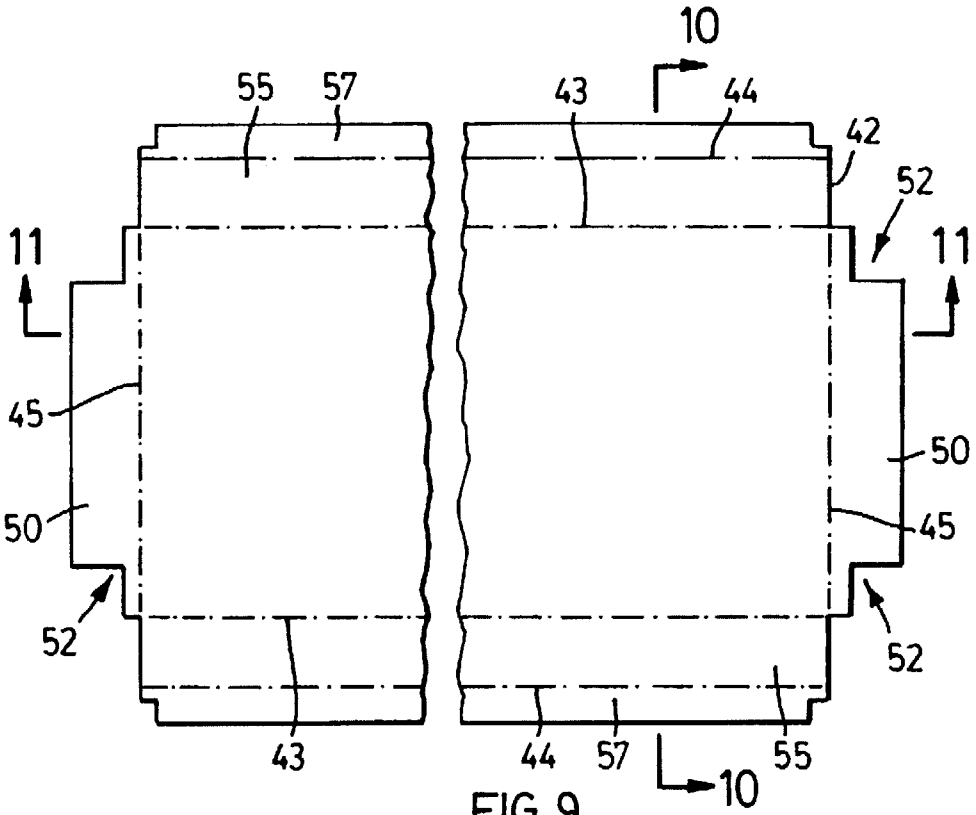
FIG. 9 is a partial plan view of a blank which will become, after folding, a shelf component.
Figure 11:
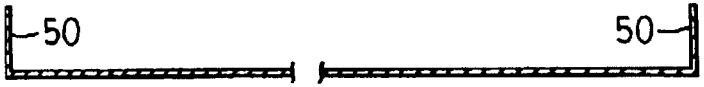
FIG. 11 is a longitudinal sectional view through the blank of FIG. 9, after folding, taken at the line 11—11 in FIG. 9.

Attention is now directed to FIG. 9, which illustrates a shelf component blank, after the edges have been stamped but prior of folding. FIGS. 10 and 11 are transverse and longitudinal sections, respectively. All fold lines in FIG. 9 are shown as broken lines.

More specifically, the blank 42 for the shelf component is folded twice along each longitudinal edge, at parallel fold lines 43 and 44. In addition, the blank 42 is folded once at each lateral edge about fold line 45. The fold about line 45 produces a downwardly projecting attachment margin 50 which has at each end a generally square cut-away 52 in order to cooperate with appropriate tongues 20 on the uprights 10. In effect, the operative edges of the attachment margins 50 are displaced inwardly toward each other (thanks to the cut-away) so that the remaining portion of the margin can fit snugly between two facing tongues 20, as clearly illustrated in FIGS. 3 and 4. The shelving unit is pushed down as far it will go against the tongues 20, thus supporting the weight of the shelf 14.

In order to provide beam strength to the shelf 14, the same is provided with downwardly extending side walls 55 (folding about the longitudinal fold line 43), and is further strengthened by providing, along the bottom edge of each wall 55, an inwardly extending flange 57 (folding about the fold line 44).

The flange 57 has, at each end, a rectangular cut-away 60, the purpose of which is to allow the flange 57 to avoid contact with the tongues 20 when the shelf unit is put into place.

Figure 4:
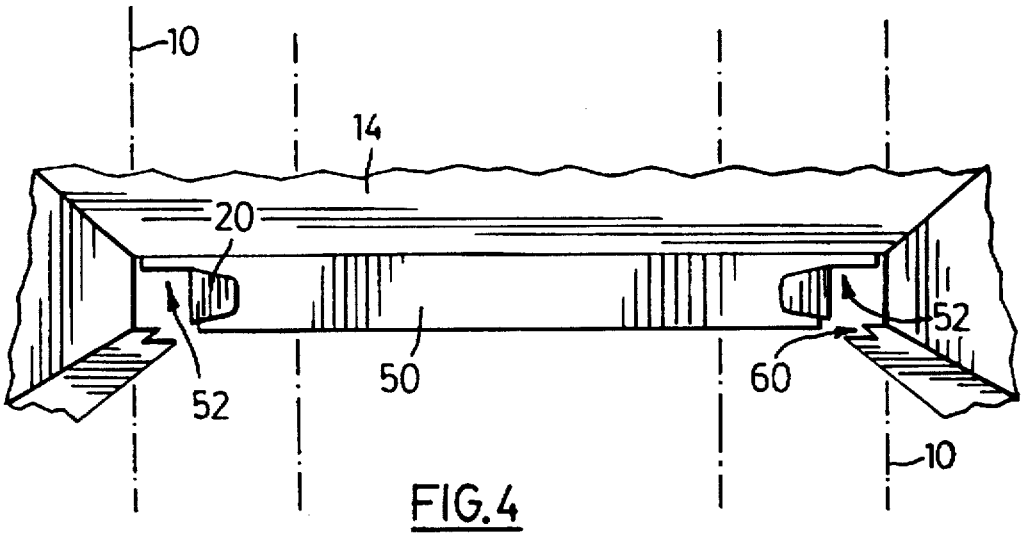
FIG. 4 is a perspective view of one end of a shelf, seen from underneath and looking in the direction of the uprights.

FIG. 4 shows a view from "inside" and under a shelf component, looking in perspective toward the end where the shelf is connected to and supported by uprights 10. In this Figure, the horizontal shading lines designate panels that are horizontal, while vertical shading lines designate panels that are vertical.

Attention is directed to FIG. 2, which shows one possible position of cross-braces 65, the purpose of which is to stiffen the shelving unit in the left-to-right direction. Although one possible construction is to use threaded or similar fasteners to secure the ends of the cross-braces 65 to appropriate locations on the uprights 10 (more specifically on the webs 28 of the uprights 10), it is contemplated that the ends of the cross-braces 65 be provided with a snap-in modality, which may be one of several different kinds already known.

While one embodiment of this invention has been illustrated in the accompanying drawings and described hereinabove, it will be evident to those skilled in the art that changes and modifications may be made therein, without departing from the essence of this invention, as set forth in the appended claims.

The embodiments of the invention in which an exclusive property or privilege is claimed are defined as follows:

1. A shelving construction comprising a) a plurality of upright members each having substantially a U-shaped cross-section including two opposed, flat, uniformly spaced-apart, substantially parallel flanks interconnected by a web portion from which the flanks extend, each flank terminating at a respective free edge; b) a plurality of shelves connected between upright members; and c) at least one stiffener plate sized to extend between and into two upright members which are disposed such that the flanks of each upright member extend toward the other upright member, the stiffener plate having an effective width such that it is snugly received within both upright members, each upright member defining at least one bridging portion, the stiffener plate having, for each bridging portion, two spaced-apart protrusions such that said bridging portion can snap into the space between the protrusions when the stiffener plate is inserted into the respective upright member; the stiffener plate being a substantially rectangular panel having two opposed edges adapted to enter respective upright members, and a further two opposed edges along each of which a marginal portion is bent substantially at right angles, the width of the marginal portions determining said snug reception into the upright members; each of the upright members connected by a given stiffener plate having a pair of longitudinally spaced-apart apertures in at least one flank, each aperture being spaced inward from the corresponding free edge of the flank, whereby each said bridging portion is defined by an integral, vertical, longitudinally extending strap of material between the aperture and the free edge.

2. The improvement claimed in claim 1, in which the free edge of each apertured flank has an indent adjacent the location of each aperture, whereby said strap of material extends between the aperture and the indent.

3. The improvement claimed in claim 2, in which both flanks of each upright member are identically provided with apertures and indents, to allow the stiffener plate to be inserted with said panel adjacent either flank.

4. The improvement claimed in claim 1, in which each marginal portion is bevelled adjacent both ends thereof, so as to facilitate entry of the stiffener plate into the upright members.

5. A shelving construction comprising a) a plurality of upright members each having substantially a U-shaped cross-section including two opposed, spaced-apart, substantially parallel flanks interconnected by a web portion from which the flanks extend; b) a plurality of shelves connected between upright members; and c) at least one stiffener plate sized to extend between and into two upright members which are disposed such that the flanks of each upright member extend toward the other upright member, the stiffener plate having an effective width such that it is snugly received within both upright members, each upright member defining at least one bridging portion, the stiffener plate having, for each bridging portion, two spaced-apart protrusions such that said bridging portion can snap into the space between the protrusions when the stiffener plate is inserted into the respective upright member; at least one flank of each upright member having a plurality of longitudinally spaced-apart, stamped-out tongues, each tongue being integral with the flank along a joining line parallel with the upright member, a major portion of each tongue lying parallel with the respective flank but spaced outward therefrom; each said shelf including a main panel with substantially straight edges of which two are rectilinear end edges intended for securement to upright members; each said end edge having an attachment margin projecting downwardly at right angles from said main panel, said attachment margin having at each end a recess defined at least in part by an upright edge, whereby the shelf can be supported from the upright members with the two upright edges being lodged between the respective tongues and the respective flanks of the upright members, with the weight of the shelf being carried by the tongues, the main panel of each shelf being rectangular with the end edges being the shorter edges, each of the longer two edges having an integral, downwardly extending side wall of uniform vertical extent, which in turn has a horizontal flange extending inwardly from the bottom of the side wall, the inner corner at each end of the flange being notched to avoid mechanical interference with the supporting tongues during installation and removal of the shelf.

6. The improvement claimed in claim 5, in which the stiffener plate is a substantially rectangular panel with two shorter edges adapted to enter respective upright members, and two longer edges along each of which a marginal portion is bent substantially at right angles, the width of the marginal portions determining said snug reception into the upright members.

7. The improvement claimed in claim 6, in which each of the upright members connected by a given stiffener plate has a pair of longitudinally spaced-apart apertures in at least one flank, each aperture being spaced inward from a corresponding free edge of the flank, whereby each said bridging portion is defined by an integral, longitudinally extending strap of material between the aperture and the free edge.

8. The improvement claimed in claim 7, in which the free edge of the flank has an indent at the location of each aperture, whereby said strap of material extends between the aperture and the indent.

9. The improvement claimed in claim 8, in which both flanks of each upright member are identically provided with apertures and indents, to allow the stiffener plates to be inserted with said panel adjacent either flank.

10. The improvement claimed in claim 6, in which each marginal portion is bevelled adjacent both ends thereof, so as to facilitate entry of the stiffener plate into the upright members.

11. In a shelving construction including a) a plurality of upright members each having substantially a U-shaped cross-section including two opposed, spaced-apart flanks interconnected by a web portion from which the flanks extend; and b) a plurality of shelves connected between upright members; the improvement comprising:

the provision, on at least one flank of each upright member, of a plurality of longitudinally spaced-apart, stamped-out tongues, each tongue being integral with the flank along a joining line parallel with the upright member, a major portion of each tongue lying parallel with the respective flank but spaced outward therefrom; each said shelf including a main panel with substantially straight edges of which two are rectilinear end edges intended for securement to upright members; each said end edge having an attachment margin projecting downwardly at right angles from said main panel, said attachment margin having at each end a recess defined at least in part by an upright edge, whereby the shelf can be supported from the upright members with the two upright edges lodged between the respective tongues and the respective flanks of the upright members, with the weight of the shelf being carried by the tongues, the main panel of each shelf being rectangular with the end edges being the shorter edges, each of the longer two edges having an integral, downwardly extending side wall of uniform vertical extent, which in turn has a horizontal flange extending inwardly from the bottom of the side wall, the inner corner at each end of each flange being notched to avoid mechanical interference with the supporting tongues during installation and removal of the shelf.

12. A shelving construction comprising: a) a plurality of upright members each having substantially a U-shaped cross-section including two opposed, spaced-apart flanks interconnected by a web portion from which the flanks extend; b) a plurality of shelves connected between upright members; and, c) on at least one flank of each upright member, a plurality of longitudinally spaced-apart, stamped-out tongues, each tongue being integral with the flank along a joining line parallel with the upright member, a major portion of each tongue lying parallel with the respective flank but spaced outward therefrom; each said shelf including a main panel with substantially straight edges of which two are rectilinear end edges intended for securement to upright members; each said end edge having an attachment margin projecting downwardly at right angles from said main panel, said attachment margin having at each end a recess defined at least in part by an upright edge, whereby the shelf can be supported from the upright members with the two upright edges lodged between the respective tongues and the respective flanks of the upright members, with the weight of the shelf being carried by the tongues, the main panel of each shelf being rectangular with the end edges being the shorter edges, each of the longer two edges having an integral, downwardly extending side wall of uniform vertical extent, which in turn has a horizontal flange extending inwardly from the bottom of the side wall, the inner corner at each end of each flange being notched to avoid mechanical interference with the supporting tongues during installation and removal of the shelf.

* * * * *